United States Patent [19]

Timmons

[11] Patent Number: 5,035,340

[45] Date of Patent: Jul. 30, 1991

[54] VALVED NIPPLE FOR BABY BOTTLE

[76] Inventor: Sarah J. Timmons, 10 Turners Cir., Lexington, S.C. 29072

[21] Appl. No.: 484,679

[22] Filed: Feb. 26, 1990

[51] Int. Cl.[5] ..... A61J 9/00; A61J 11/00

[52] U.S. Cl. ..... 215/11.4; 215/11.1

[58] Field of Search ..... 215/11.1–11.6

[56] References Cited

U.S. PATENT DOCUMENTS

| | | | |
|---|---|---|---|
| 467,176 | 1/1892 | Jensen | 215/11.4 |
| 1,146,639 | 7/1915 | Miller | 215/11.5 |
| 1,212,819 | 1/1917 | Sakanai | 215/11.5 |
| 1,431,762 | 10/1922 | Sellers | 215/11.4 |
| 1,569,693 | 1/1926 | Young | 215/11.4 |
| 1,590,152 | 6/1926 | Dreyfus | 215/11.1 |
| 2,174,361 | 9/1939 | Condon | 215/11.5 |
| 2,442,656 | 6/1948 | Less | 215/11.4 |
| 2,584,359 | 2/1952 | Miles | 215/11.4 |
| 2,597,483 | 5/1952 | Head, Sr. | 215/11.4 X |
| 2,623,524 | 12/1952 | Clemens | 215/11.4 |
| 2,669,234 | 2/1954 | Baracate | 215/11.4 |
| 2,708,421 | 5/1955 | Jauch | 215/11.4 X |
| 2,747,573 | 5/1976 | Schaich | 215/11.4 |
| 2,764,155 | 9/1956 | Meyers | 215/11.4 |
| 2,803,251 | 8/1957 | White | 215/11.4 |
| 2,827,191 | 3/1958 | Baracate | 215/11.4 |
| 2,876,772 | 3/1959 | Witz | 215/11.4 |
| 2,876,773 | 3/1959 | Witz | 215/11.4 |
| 2,959,319 | 11/1960 | Sanchez | 215/11.1 |
| 2,960,088 | 11/1960 | Witz | 215/11.4 |
| 2,979,078 | 4/1961 | Witz | 215/11.4 X |
| 3,134,494 | 5/1964 | Quinn | 215/11.3 |
| 3,424,157 | 1/1969 | Di Paolo | 215/11.4 |
| 3,547,296 | 12/1970 | Greenberg | 215/11.4 |
| 4,320,883 | 3/1982 | Bass | 248/104 |
| 4,339,046 | 7/1982 | Coen | 215/11.4 X |
| 4,685,577 | 8/1987 | Chen | 215/11.4 X |

FOREIGN PATENT DOCUMENTS

| | | | |
|---|---|---|---|
| 63500 | 7/1892 | Fed. Rep. of Germany | 215/11.1 |
| 2169210 | 7/1986 | United Kingdom | 215/11.4 |

*Primary Examiner*—Sue A. Weaver

[57] ABSTRACT

A nipple system for bottle-feeding a baby, comprising a hollow, pliant nipple with a small aperture at one end and open at the other end and a one-way valve interior to the nipple for allowing a flow of liquid as the baby opens the valve by compressing the nipple. The valve is located in the nipple and preferably also pliant and integral therewith, dividing the nipple into two chambers, communicating through a passage in the valve. The valve may comprise a flap that opens the passage when the nipple is compressed and closes when the nipple is released, or may be a slotted diaphragm biased toward the bottle that opens when the nipple is compressed.

4 Claims, 1 Drawing Sheet

VALVED NIPPLE FOR BABY BOTTLE

BACKGROUND OF THE INVENTION

1. Field of the Invention

The present invention relates to nipples for baby bottles. More specifically, the present invention relates to valved nipples for baby bottles.

2. Discussion of Background

The conventional nursing nipple for feeding a baby is designed to allow the extraction of liquid from the bottle as a result of minimal sucking effort. This minimal effort does little to develop the mastication muscles and stimulate mandibular growth. In addition, the large volume of liquid made available to the baby by a conventional nursing nipple may cause the baby to develop "tongue thrust" in the baby's effort to regulate the flow of liquid from the nipple. Other problems that develop in babies and are traceable to conventional nipples are deformation of soft bone tissue, malocclusions, finger sucking, lisping, and the like.

Conventional nipples have little comparison to the human breast which requires the baby to use the natural combination of lips and gums to compress the nipple while the tongue guides and supports the nipple but does not regulate the flow of milk. In contrast, the operation of conventional bottle nipples encourages the baby to suck lightly and control the rate of flow of the liquid with a tongue thrust action.

Another disadvantage of conventional nipples used for bottle feeding of babies is the occurrence of colic caused by air swallowed during the feeding. Also, conventional bottles frequently leak from the nipple if the bottle is inverted.

There is a need for a baby bottle nipple that avoids the problems of conventional bottle nipples and encourages correct functioning of the lips, tongue, gums and facial muscles groups.

SUMMARY OF THE INVENTION

In accordance with its major aspects, the present invention is a nipple system for bottle-feeding a baby, comprising a hollow, pliant nipple with a small aperture at one end, and opening at the other end and a one-way valve interior to the nipple for allowing a flow of liquid as the baby opens the valve by compressing the nipple. The valve is preferably also pliant and integral with the nipple, dividing the nipple into two chambers that communicate through a passage in the valve. The valve may have a flap that uncovers the passage when the niple is compressed and closes when the nipple is released, or may be a slotted diaphragm, biased toward opening, that opens when the nipple is compressed.

A feature of the present invention is the valve which causes a control of the flow of liquid approximate to the natural breast. This feature requires the baby to compress the nipple with lips and jaws in order to receive the liquid from the bottle. The advantage to this feature is the required use of a combination of lips and gums acting together which is instinctive to the baby when feeding and promotes the proper development of muscles and bone tissue.

The valve of the present invention has another advantage over the conventional nipples. The present invention restricts the amount of air entering the bottle and thus reduces the likelihood of colic in the baby caused by the ingestion of air with the liquid.

Yet another feature of the present invention is the one-way flow allowed by the interior valve. When there is a compressive force against the nipple, as by the baby's lips and gums squeezing the nipple, the valve opens toward the bottle and allows the liquid within the bottle to flow into the nipple. When there is no compressive force against the nipple, the valve blocks the flow of liquid from beyond the valve from entering the passage. This advantage will be apparent to anyone with a child who holds its bottle whiles feeding. Many times the child will toss or drop its bottle only to have the contents leak out. With the present invention, there will be reduced leaking from the nipple because the valve will not allow the liquid to pass.

Another feature of the present invention is the integral nature of the valve within the nipple, in the preferred embodiment, so there need be no parts to remove for cleaning and no parts to misplace as in some of the conventional valved nipples.

Another feature of the present invention is the various degrees of pliancy that can be designed into a given model of an integral valve or into valves inserted into a nipple to coordinate with the various stages of development and strength of a baby's lips and gums. The advantage of this feature is it allows selection of a valve having the appropriate stiffness or resistance for the baby's stage of development and strength of nursing musculature.

Other objects and features of the present invention will become apparent from the following detailed description when taken in connection with the accompanying drawings which disclose embodiments of the invention.

BRIEF DESCRIPTION OF THE DRAWINGS

The accompanying drawings, which are incorporated in and form a part of the specification, illustrated the invention and, together with the description, serve to explain the principles of the invention. In the drawings.

It is to be understood that the drawings are designed for the purpose of illustration only and are not intended as a definition of the limits of the invention.

DETAILED DESCRIPTION OF THE INVENTION

Figure 1:
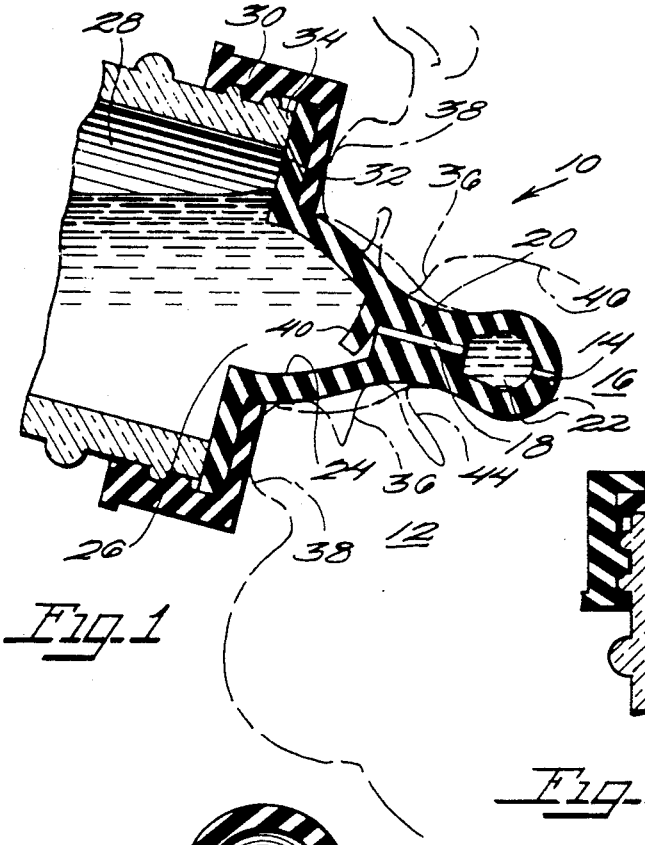
FIG. 1 is a cross-sectional side view of the nipple system according to the present invention, shown within a baby's mouth with a flap valve in the open position.

Referring now in detail to the drawings in which similar numbers denote similar parts throughout the several drawings, in FIG. 1 a nipple system 10 is shown placed in the mouth of a baby 12 with an aperture 14 located towards the baby's throat 16. A valve means 18 is located within a hollow nipple 20 delineating a first chamber 22 between valve means 18 and aperture 14, and a second chamber 24 between valve means 18 and an opening 26 of nipple 20 into a bottle 28. Valve means 18 is pliant and integral with hollow nipple 20. Valve means 18 may be any of various thicknesses selected to correspond to the development of the nursing baby.

Valve means 18 is decipted in the open position thereby allowing the passage of liquid from bottle 28 and second chamber 24 into first chamber 22. Nipple 20 and bottle 28 are held together by a collar 30 which threads onto bottle 28 compressing the nipple rim 32 into contact with a bottle lip 34. As is shown in FIG. 1, the baby's gums 36 and lips 38 surround nipple 20 and the pressure applied therefrom causes the deformation of nipple 20 and valve means 18 so that a valve 40 opens toward bottle 28 allowing liquid from second chamber 24 to flow through a passage 42 of valve means 18 into first chamber 22 to be squeezed therefrom by the action of the baby's tongue 44 and palate 46. Whether integral with nipple 20 or inserted into nipple 20, valve means 18 is positioned within nipple 20 where the baby's gums and lips will open valve 40 by distortion of the pliant valve means 18.

Figure 2:
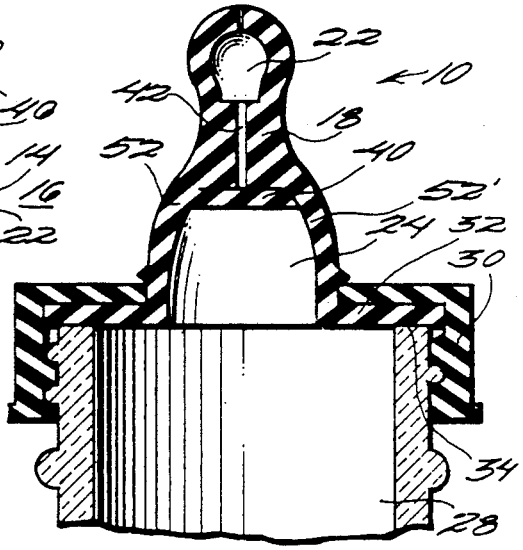
FIG. 2 is a cross-sectional side view of the nipple system according to the present invention, showing the flap valve in the closed position.

FIG. 2 shows nipple system 10 in its closed position. Passage 42 connecting first chamber 22 to second chamber 24 and bottle 28 is closed by valve means 18. Passage 42 of valve means 18 is blocked at valve 40. Nipple 20 is held securely to bottle 28 by collar 30 which threads onto bottle 28 and presses nipple rim 32 to bottle lip 34. This sealing method facilitates nonleakage of liquid from bottle 28 at nipple 20 juncture. This sealing method also facilitates the ease of cleaning of nipple system 10. Because valve means 18 is integral with nipple 20, no parts can be misplaced during the cleaning process. Because nipple 20 and bottle 28 are separate components of nipple system 10, they may be separated easily and replaced with new or modified components of system 10, depending on the development of the baby or the wear to a given component.

In operation, when nursing, the baby w grip nipple system 10 between its lips 38 and gums 36 and exert pressure on nipple 20 distorting the side walls 52, 52' so as to cause valve 40 to move toward second chamber 24 allowing the liquid within bottle 28 to flow past valve 40 and through passage 42 of valve means 18 into first chamber 22 and out through aperture 14 into baby's throat 16. This combination of gripping and pressing motions by the baby is closely related to the combination necessary in breast feeding. This combination of motions stimulates the proper musculature and mandibular development.

Figure 3:
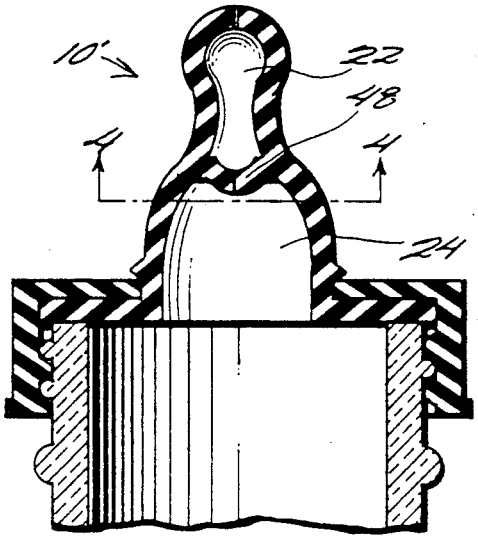
FIG. 3 is a cross-sectional side view of the nipple system with a diaphragm valve in the closed position.

FIG. 3 shows a second preferred embodiment of the present invention with diaphragm 48 separating first chamber 22 from second chamber 24. Diaphragm 48 protrudes into second chamber 24. In FIG. 3 diaphragm 48 is shown closed. When system 10 is inverted with diaphragm 48 closed as illustrated because no pressure is applied to side walls 52, 52', the liquid within bottle 28 presses against diaphragm 48, exerting force on the protrusion so as to increase the contact pressure within diaphragm 48 and seal even more securely second chamber 24 from first chamber 22 thereby prohibiting leakage from second chamber 24.

Figure 4:
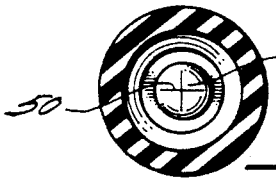
FIG. 4 is a cross-sectional view through line 4—4 of FIG. 3.

FIG. 4, a cross section of nipple system 10 taken along the line 4—4 of FIG. 3 is shown. Diaphragm 48 has slit configuration 50 therethrough, with at least one and preferably two slits at right angles. Other configurations of slits are readily apparent without deviating from the general design of nipple system 10. In FIG. 4, nipple system 10 is depicted with no pressure exerted thereon and slit 50 is in the closed or sealed position within diaphragm 48.

Figure 5:
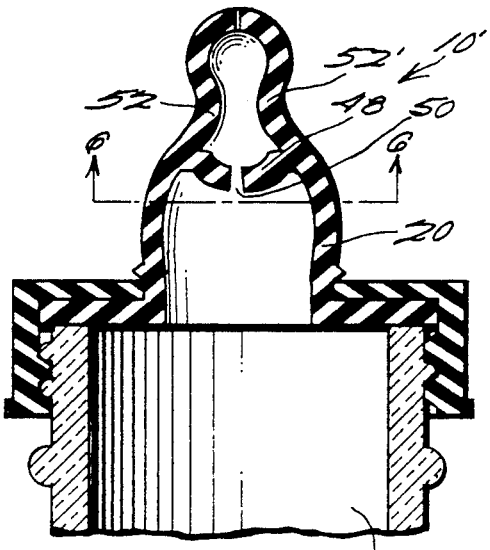
FIG. 5 is a cross-sectional side view of the nipple system with a diaphragm valve in the open position.

FIG. 5 shows the second preferred embodiment of the present invention with diaphragm 48 opened. Side walls 52, 52' of nipple 20 are deformed much as they would be by the action of a baby's lips and gums. Slit configuration 50 in diaphragm 48 bulges with the force of the deformation allowing the liquid from bottle 28 and second chamber 24 to flow through slit configuration 50 of diaphragm 48 and into first chamber 22. The nursing baby may then receive the liquid from first chamber 22 by combination of compressive action of its tongue and palate and swallowing.

Figure 6:
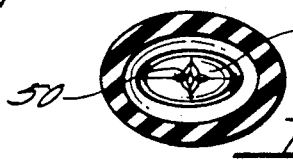
FIG. 6 is a cross-sectional view through line 6—6 of FIG, 5.

In FIG. 6, a cross section of nipple system 10 taken along the line 6—6 of FIG. 5 is shown. Slit configuration 50 of diaphragm 48 is depicted bulged open as by the force of a baby's lips and gums.

The foregoing embodiments are illustrated only. Numerous other modifications and changes will readily occur to those persons skilled in the pertinent art after reading this disclosure. Consequently, the disclosed invention is not limited to the exact construction and operation shown and described herein but rather is encompassed within the scope of the letter and spirit of the appended claims.

What is claimed is:

1. A nipple system for bottle-feeding a baby, comprising:

a hollow, pliant nipple having an aperture at one end and an opening in an opposing, bottle engaging end; and valve means interior to said nipple for allowing a flow of liquid as the baby opens said valve means by compressing said nipple, said valve means having an opening side and an aperture side and a passage therethrough connecting said opening side and said aperture side, said opening side of said valve means and said nipple defining a first chamber and said aperture side of said valve means and said nipple defining a second chamber, said first and said second chambers communicating through said passage, said aperture side of said valve means facing said aperture, said opening side of said valve means facing said opening;

said valve means further comprising a flap adjacent said opening side of said valve for covering said passage, said flap having an edge, said edge having an attached portion and an unattached portion, said unattached portion separating from said opening side toward said opening to open said valve means when said nipple is compressed and engaging said opening side to close said valve means when said nipple is released.

2. The nipple system recited in claim 1. wherein said valve means is pliable and integral with said nipple.

3. A baby bottle system, comprising;

a bottle;

a hollow, pliant nipple releasibly attached to said bottle and having an aperture at one end and an opening in an opposing, bottle engaging end; and valve means interior to said nipple for allowing a flow of liquid from said bottle as the baby opens said valve means by compressing said nipple, said valve means having an opening side and an aperture side and a passage therethrough connecting said opening side and said aperture side, said opening side of said valve means and said nipple defining a first chamber and said aperture side of said valve means and said nipple defining a second chamber, said first and said second chambers communicating through said passage, said aperture side of said valve means facing said aperture, said opening side of said valve means facing said opening;

said valve means further comprising a flap adjacent said opening side of said valve for covering said passage, said flap having an edge, said edge having an attached portion and an unattached portion, said unattached portion separating from said opening side toward said bottle to open said valve means when said nipple is compressed and engaging said opening side to close said valve means when said nipple is released.

4. The baby bottle system recited in claim 3, wherein said valve means is pliable and integral with said nipple.

* * * * *